US008297996B2

(12) United States Patent
Chuang

(10) Patent No.: US 8,297,996 B2
(45) Date of Patent: Oct. 30, 2012

(54) SAFETY SOCKET

(75) Inventor: Yu-Chin Chuang, New Taipei (TW)

(73) Assignee: Dongguan Kotec Electrical Utensils Co., Ltd., Dongguan, GD (CN)

( * ) Notice: Subject to any disclaimer, the term of this patent is extended or adjusted under 35 U.S.C. 154(b) by 0 days.

(21) Appl. No.: 13/006,944

(22) Filed: Jan. 14, 2011

(65) Prior Publication Data

US 2012/0164861 A1 Jun. 28, 2012

(51) Int. Cl.
*H01R 29/00* (2006.01)

(52) U.S. Cl. ..... 439/188

(58) Field of Classification Search ..... 439/188; 200/51.09, 51.1, 51.2
See application file for complete search history.

(56) References Cited

U.S. PATENT DOCUMENTS 7,070,432 B1 7/2006 Lin
7,884,292 B2 * 2/2011 Zhang et al. ..... 200/51.02
* cited by examiner

*Primary Examiner* — Javaid Nasri
(74) *Attorney, Agent, or Firm* — Rosenberg, Klein & Lee

(57) ABSTRACT

A safety socket includes a first conductive clamp seat and a second conductive clamp seat in alignment with a first insertion hole and a second insertion hole. In normal state, the first and second conductive clamp seats are spaced from a first power terminal and a second power terminal in an open state. When a plug is plugged into the safety socket, the prongs of the plug outward bias spring limbs of the first and second conductive clamp seats into contact with the corresponding first and second power terminals respectively. Only under such circumstance, the first and second conductive clamp seats electrically contact the first and second power terminals to close the circuit and provide power for an electric appliance. If a child inserts a conductive article into the first or second insertion hole, the danger of electrical shock can be avoided to ensure safety in use of electricity.

3 Claims, 8 Drawing Sheets

SAFETY SOCKET

BACKGROUND OF THE INVENTION

1. Field of the Invention

The present invention relates to a safety socket. The safety socket includes a first conductive clamp seat and a second conductive clamp seat in alignment with a first insertion hole and a second insertion hole respectively. In normal state, the first and second conductive clamp seats are spaced from a first power terminal and a second power terminal without current passing therethrough. Only when a plug is correctly plugged into the safety socket, the first and second conductive clamp seats electrically contact the first and second power terminals to close the circuit and provide power for an electric appliance. Therefore, in case a child inserts a conductive article into the first insertion hole or the second insertion hole, the circuit remains open so as to avoid the danger of electrical shock.

2. Description of the Prior Art

A conventional power socket has two conductive clamp seats mounted in the power socket and directly connected to a set of power wires. The prongs of a plug can be inserted into the insertion holes of the power socket to electrically connect with the conductive clamp seats. In general, the insertion holes of such power socket are open. As a result, in case a child inserts an alien conductive article into any of the insertion holes, an accident of electrical shock is very likely to happen. To avoid such accident, U.S. Pat. No. 7,070,432, entitled "safety socket device", provides a safety socket including a conductor member 40 having four end segments 42. The socket can normally supply power only when all the four end segments 42 are in an on state. Such design seems to achieve higher security in use of electricity. However, in fact, it is not what it appears to be. This is because in the case that the metal piece inserted into the insertion hole by mistake has a width insufficient for the metal piece to trigger two opposite end segments 42 in the same insertion hole, the metal piece will be unable to outward bias any resilient end segment 42 without supporting both ends of the metal piece. Therefore, it is unnecessary to provide the end segments 42 at both ends of the same insertion hole. In fact, only one end of the insertion hole needs to have the end segment 42 to achieve the same effect as the above Patent. In the socket of the above Patent, four end segments 42, first conductor limbs 31 and second conductor limbs 32 are troublesomely provided. This leads to a complicated structure of the entire socket. As a result, the manufacturing cost of such socket is higher and the possibility of failure is increased. This is because after a period of use, in case any of the end segments 42 has poor contact due to elastic fatigue, even if a true plug is correctly plugged into the socket, it is still impossible to turn all four end segments 42 closed to supply power normally.

SUMMARY OF THE INVENTION

It is therefore a primary object of the present invention to provide a safety socket including a first conductive clamp seat and a second conductive clamp seat in alignment with a first insertion hole and a second insertion hole respectively. In normal state, the first and second conductive clamp seats are spaced from a first power terminal and a second power terminal in an open state. In case a child inserts an alien conductive article with a certain shape and size into the first insertion hole or the second insertion hole, the alien conductive article cannot make the first and second conductive clamp seats into contact with the first and second power terminals. Therefore, the circuit will remain open so as to avoid the danger of electrical shock.

It is a further object of the present invention to provide the above safety socket, which has simplified structure and is manufactured at lower cost.

It is still a further object of the present invention to provide the above safety socket, which can be truly electrically connected to the power supply so as to ensure safety in use of electricity.

It is still a further object of the present invention to provide the above safety socket, which has perforations for the water or water vapor entering the safety socket to automatically escape out of the safety socket. Therefore, the problem of leakage of electricity can be overcome.

To achieve the above and other objects, the safety socket of the present invention has at least one set of insertion holes. A first conductive clamp seat and a second conductive clamp seat are protectively aligned with a first insertion hole and a second insertion hole of each set of insertion holes. In normal state, the first and second conductive clamp seats are spaced from a first power terminal and a second power terminal, which are connected to a power supply, in an open state. When the prongs of a plug are correctly inserted into the first and second insertion holes, the prongs of the plug outward bias spring limbs of the first and second conductive clamp seats into contact with the corresponding first and second power terminals. Only under such circumstance, the first and second power terminals electrically contact the corresponding first and second conductive clamp seats to close the circuit so as to provide power for an electric appliance. In normal state, the first and second conductive clamp seats are spaced from the first and second power terminals without current passing therethrough. Therefore, in case a child inserts a conductive article into the first insertion hole or the second insertion hole, the danger of electrical shock can be avoided to ensure safety in use of electricity.

The present invention can be best understood through the following description and accompanying drawings, wherein:

DETAILED DESCRIPTION OF THE PREFERRED EMBODIMENTS

Figure 4:
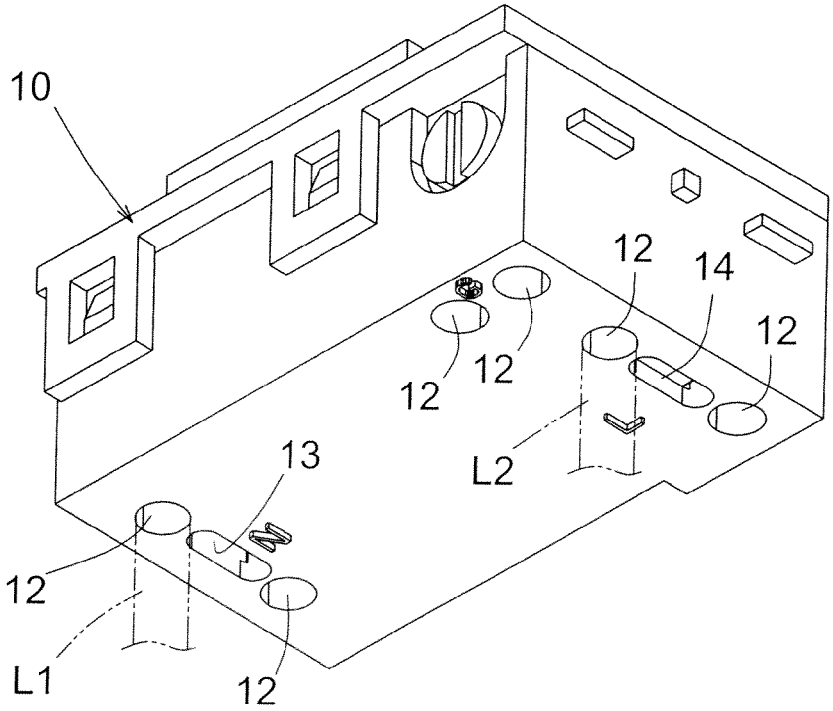
FIG. 4 is a perspective assembled view of the first embodiment of the present invention, seen in another direction.
Figure 5:
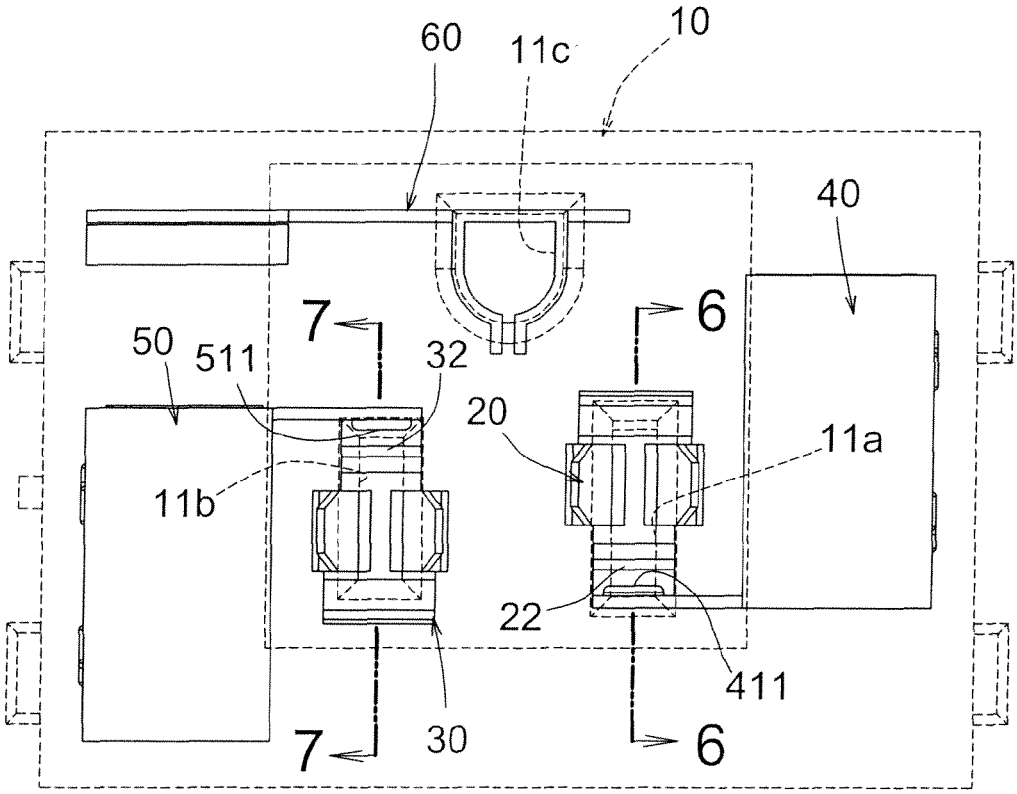
FIG. 5 is a plane view of the first embodiment of the present invention, showing the structure thereof.
Figure 6:
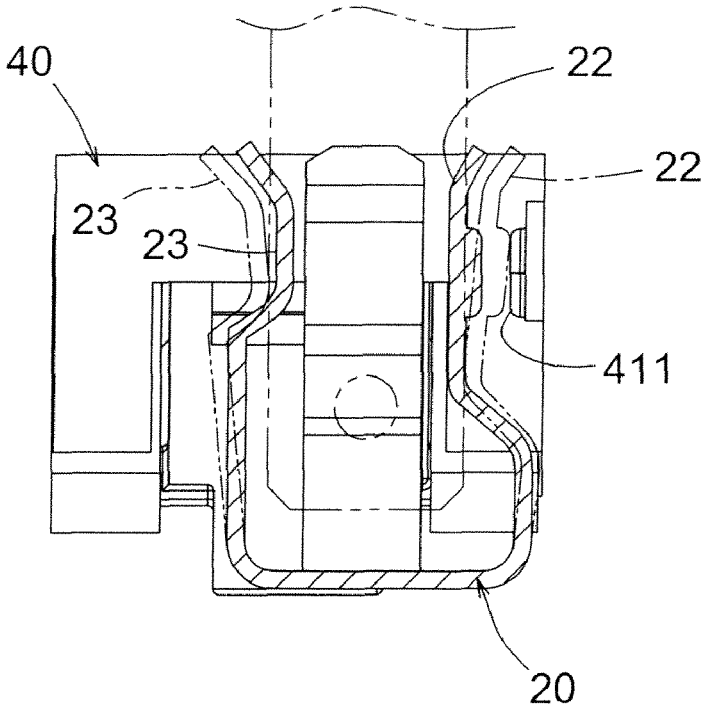
FIG. 6 is a partially sectional view taken along line 6-6 of FIG. 5, showing that the prong of the plug is inserted into the insertion hole.
Figure 7:
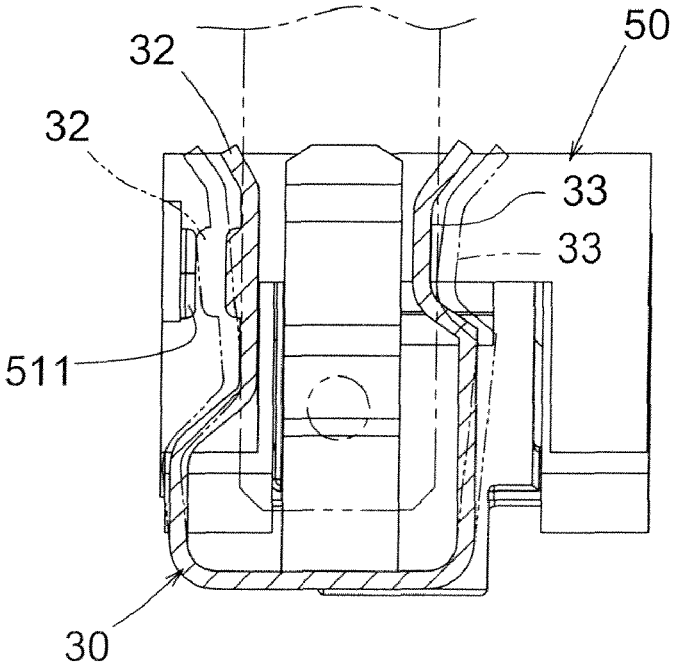
FIG. 7 is a partially sectional view taken along line 7-7 of FIG. 5, showing that the prong of the plug is inserted into the insertion hole.

Please refer to FIGS. 1 to 7. The present invention is related to a safety socket having at least one set 11 of insertion holes. A first conductive clamp seat 20 and a second conductive clamp seat 30 are projectively aligned with a first insertion hole 11*a* and a second insertion hole 11*b* of each set 11 of insertion holes. In normal state, the first and second conductive clamp seats 20, are spaced from a first power terminal 40 and a second power terminal 50, which are connected to a power supply, in an open state. When the prongs (not shown) of a plug (not shown) are correctly inserted into the first and second insertion holes 11*a*, 11*b*, the prongs of the plug are supported by opposite spring limbs 23, 33 or the edges of the first and second insertion holes 11*a*, 11*b* to outward bias the spring limbs 22, 32 into contact with the corresponding first and second power terminals 40, 50 as shown in FIGS. 6 and 7. Only under such circumstance, the first and second power terminals 40, 50 electrically contact the corresponding first and second conductive clamp seats 20, 30 to close the circuit so as to provide power for an electric appliance.

In normal state, the first and second conductive clamp seats 20, 30 are spaced from the first and second power terminals 40, 50 without current passing therethrough. Therefore, in case a child inserts a conductive article into the first insertion hole 11*a* or the second insertion hole 11*b*, the danger of electrical shock can be avoided to ensure safety in use of electricity.

The safety socket of the present invention includes a main body 10 formed with at least one set 11 of insertion holes. Each set 11 of insertion holes includes a first insertion hole 11*a* and a second insertion hole 11*b*. In addition, the main body 10 is formed with multiple lead through holes 12. The safety socket of the present invention further includes a first conductive clamp seat 20, which is projectively aligned with the first insertion hole 11*a* and mounted in the main body 10. A pair of clamp arms 21*a*, 21*b* are disposed on the first conductive clamp seat 20 for resiliently clamping two opposite sides of a prong of the plug plugged in the socket. In addition, two spring limbs 22, 23 extend from the first conductive clamp seat 20. The spring limbs 22, 23 can be outward biased by the prong of the plug plugged in the socket. The safety socket of the present invention further includes a second conductive clamp seat 30, which is projectively aligned with the second insertion hole 11*b* and mounted in the main body 10. A pair of clamp arms 31*a*, 31*b* are disposed on the second conductive clamp seat 30 for resiliently clamping two opposite sides of a prong of the plug plugged in the socket. In addition, two spring limbs 32, 33 extend from the second conductive clamp seat 30. The spring limbs 32, 33 can be outward biased by the prong of the plug plugged in the socket. The safety socket of the present invention further includes a first power terminal 40 mounted in the main body 10 and connected to a first electrode power wire L1 of a power supply without contacting the first conductive clamp seat 20. The safety socket of the present invention further includes a second power terminal 50 mounted in the main body 10 and connected to a second electrode power wire L2 of the power supply without contacting the second conductive clamp seat 20. After the plug is correctly plugged into the first and second insertion holes 11*a*, 11*b* of the set 11 of insertion holes, the spring limbs 22, 23, 32, 33 of the first and second conductive clamp seats 20, 30 are urged into contact with the corresponding first and second power terminals 40, 50 as shown in FIGS. 6 and 7 to close the circuit so as to provide power for an electric appliance.

Figure 1:
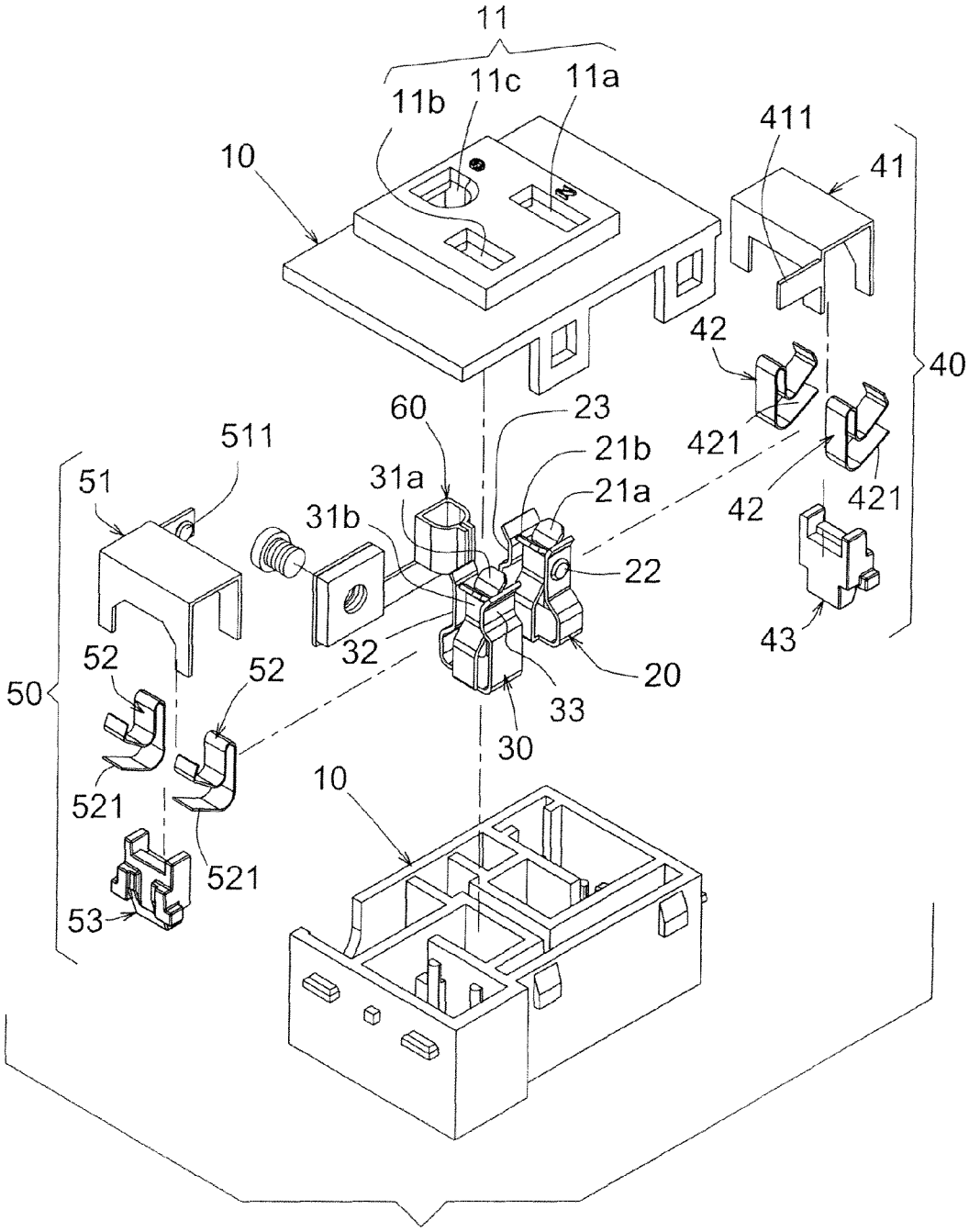
FIG. 1 is a perspective exploded view of a first embodiment of the present invention.
Figure 2:
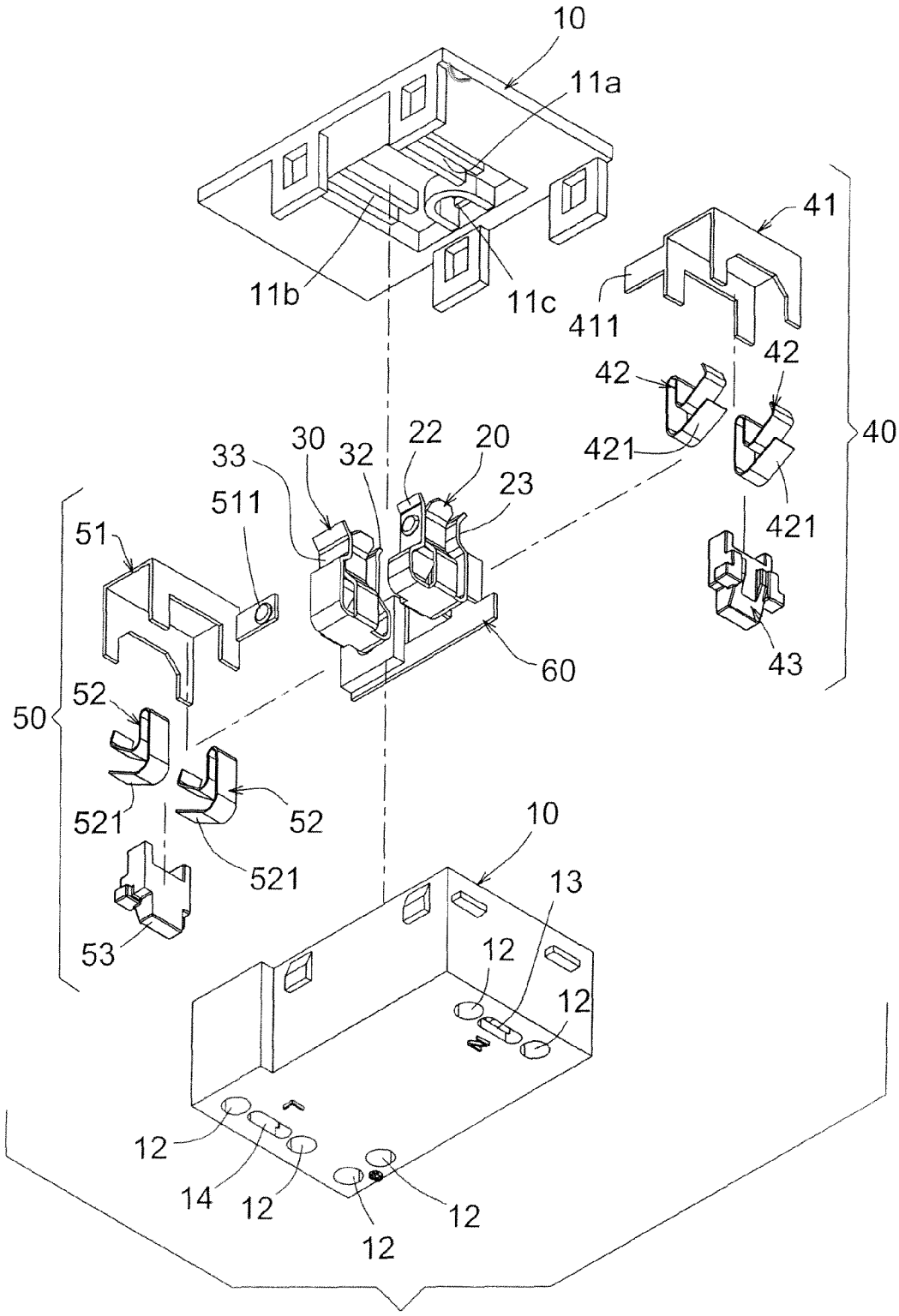
FIG. 2 is a perspective exploded view of the first embodiment of the present invention, seen in another direction.
Figure 3:
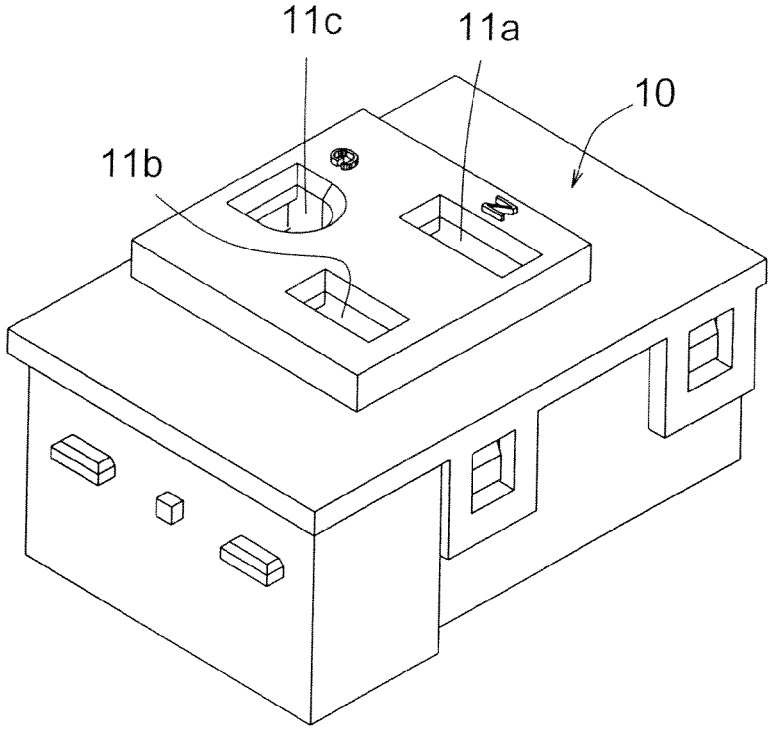
FIG. 3 is a perspective assembled view of the first embodiment of the present invention.

Please refer to FIGS. 1, 2 and 5. In the safety socket of the present invention, the first power terminal 40 includes a frame section 41 having a contact arm 411. The contact arm 411 projects from the frame section 41 toward the spring limb 22 of the first conductive clamp seat 20 in an open state. The first power terminal 40 further includes two power wire clamp arms 42 positioned between two sides of the frame section 41 and electrically connected with the frame section 41. Each power wire clamp arm 42 has an oblique arm section 421 obliquely extending from the power wire clamp arm 42 corresponding to two lead through holes 12 of the main body 10. The oblique arm sections 421 serve to elastically clamp the first electrode power wire L1 inserted in the lead through holes 12 and a lead for parallel connection. The first power terminal 40 further includes an unlatching section 43 positioned in the middle of the frame section 41 and bridged between outer sides of the oblique arm sections 421 of the power wire clamp arms 42. The unlatching section 43 is aligned with a perforation 13 of the main body 10. By means of inserting a tool into the perforation 13, the unlatching section 43 is pushed backward to retreat the oblique arm sections 421 of the power wire clamp arms 42. In this case, the inserted first electrode power wire L1 or the lead for parallel connection is unlatched.

In the safety socket of the present invention, the second power terminal 50 includes a frame body 51 having a contact section 511. The contact section 511 projects from the frame body 51 toward the spring limb 32 of the second conductive clamp seat 30 in an open state. The second power terminal 50 further includes two power wire clamp arms 52 positioned between two sides of the frame body 51 and electrically connected with the frame body 51. Each power wire clamp arm 52 has an oblique arm section 521 obliquely extending from the power wire clamp arm 52 corresponding to the other two lead through holes 12 of the main body 10. The oblique arm sections 521 serve to elastically clamp the second electrode power wire L2 inserted in the lead through holes 12 and a lead for parallel connection. The second power terminal 40 further includes an unlatching section 53 positioned in the middle of the frame body 51 and bridged between outer sides of the oblique arm sections 521 of the power wire clamp arms 52. The unlatching section 53 is aligned with another perforation 14 of the main body 10. By means of inserting a tool into the perforation 14, the unlatching section 53 is pushed backward to retreat the oblique arm sections 521 of the power wire clamp arms 52. In this case, the inserted second electrode power wire L2 or the lead for parallel connection is unlatched.

Please refer to FIGS. 1 and 4. The safety socket of the present invention further includes a grounding terminal 60. The set 11 of insertion holes further includes a grounding insertion hole 11*c*. The grounding terminal 60 is mounted in the main body 10 in alignment with the grounding insertion hole 11*c*. A grounding lead and a lead for parallel connection are connected or locked with the grounding terminal 60.

Please refer to FIGS. 8, 9, 10 and 11, which show a second embodiment of the safety socket of the present invention. In the second embodiment, the first power terminal 40*a* includes a frame section 41*a* having two contact arms 411*a*. Each contact arm 411*a* projects from one of two opposite sides of the frame section 41*a* toward the spring limb 22*a* of a first conductive clamp seat 20*a* in an open state. The first power terminal 40*a* further includes two power wire clamp arms 42*a* obliquely extending into the frame section 41*a* for elastically clamping the inserted first electrode power wire L1 and a lead for parallel connection. In the second embodiment, the second power terminal 50*a* includes a frame body 51*a* having two contact sections 511*a*. Each contact section 511*a* projects from one of two opposite sides of the frame body 51*a* toward the spring limb 32*a* of a second conductive clamp seat 30*a* in an open state. The second power terminal 50*a* further includes two power wire clamp arms 52*a* obliquely extending into the frame body 51*a* for elastically clamping the inserted second electrode power wire L2 and a lead for parallel connection.

Please refer to FIGS. 8, 9, 10 and 11. The safety socket of the present invention further includes a grounding terminal 60*a*. Each set 11 of insertion holes further includes a grounding insertion hole 11*c*. The grounding terminal 60*a* has two contact sections 61 respectively projectively in alignment with the grounding insertion holes 11*c*. Two frame sections 62 are respectively disposed on two sides of the grounding terminal 60*a*. A lead clamp seat 63 is disposed in each frame section 62 in elastic contact therewith. Each lead clamp seat 63 has a spring limb 631 and a spring lead clamp arm 632. The spring limb 631 is tightly fixed in the frame section 62 and the spring lead clamp arm 632 tightly clamps an inserted grounding lead and a lead for parallel connection. The spring lead clamp arm 632 is projectively aligned with a perforation 15 of a main body 10*a*. By means of inserting a tool into the perforation 15, the spring lead clamp arm 632 is pushed backward to unlatch the clamped grounding lead and the lead for parallel connection.

Figure 8:
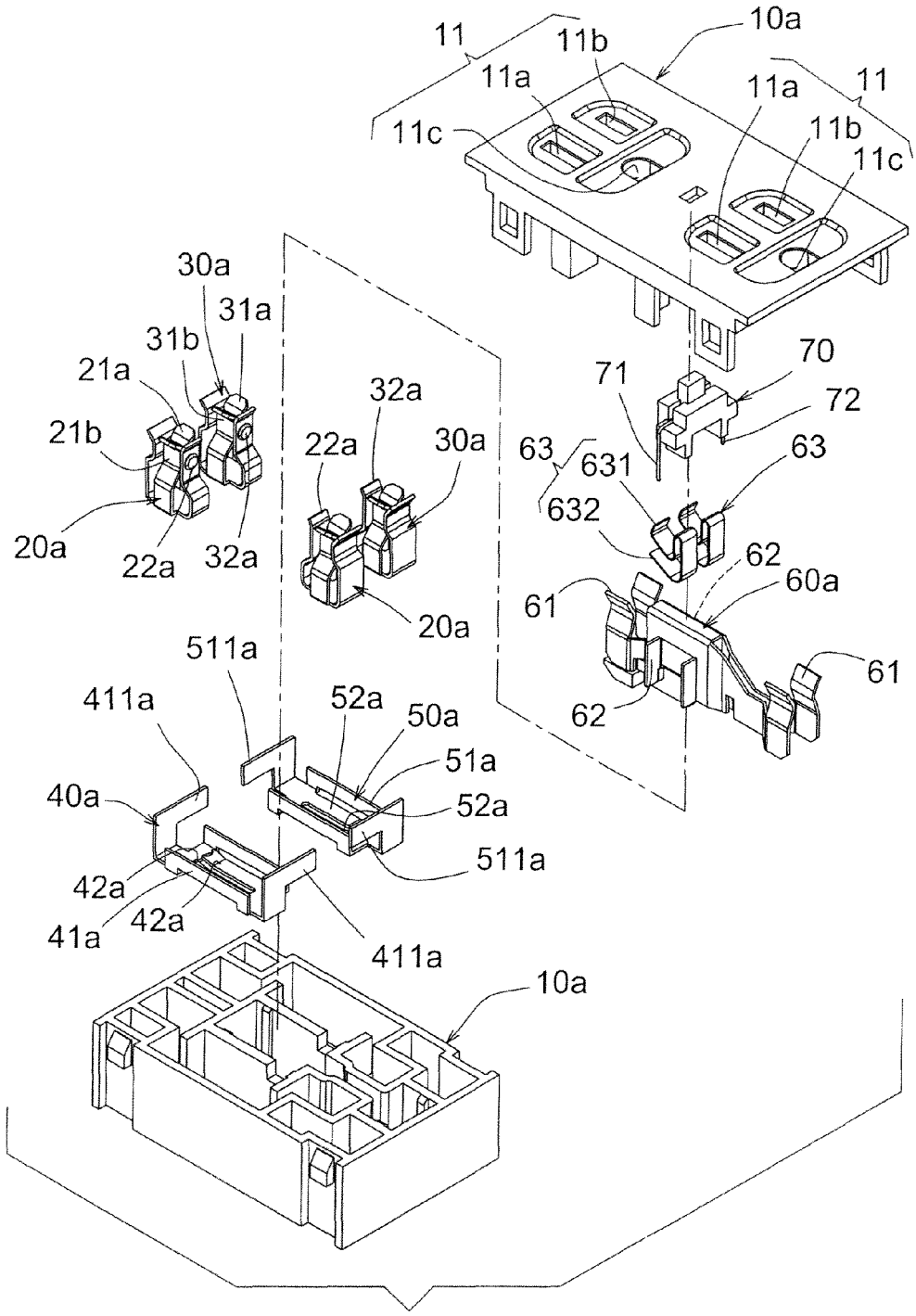
FIG. 8 is a perspective exploded view of a second embodiment of the present invention.
Figure 9:
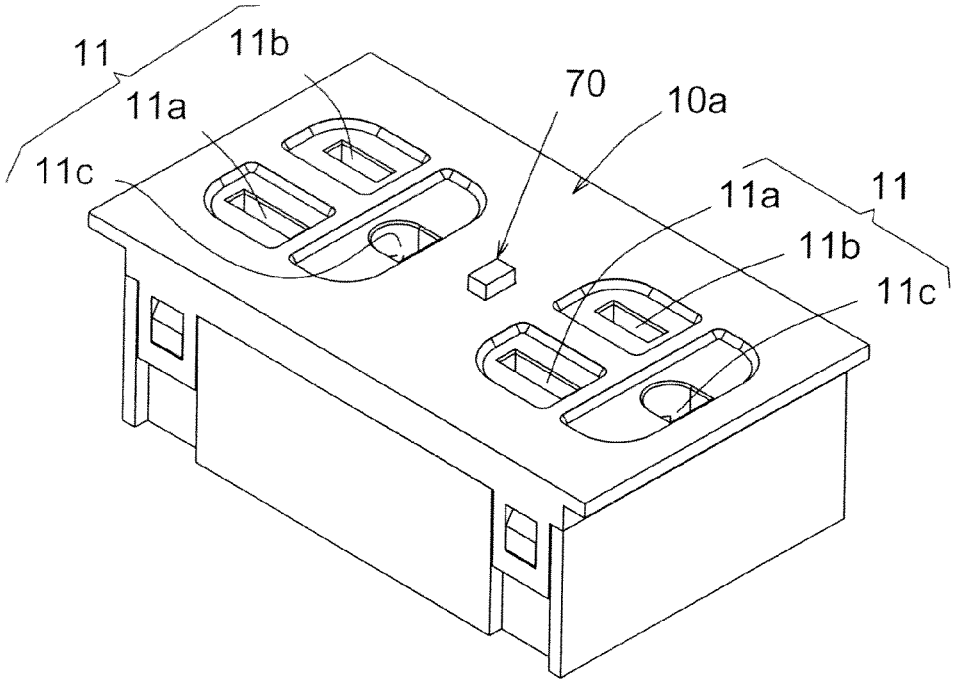
FIG. 9 is a perspective assembled view of the second embodiment of the present invention.

Please refer to FIGS. 8 and 9. The safety socket of the present invention further includes an indicator lamp 70 having two contact pins 71, 72. The two contact pins 71, 72 are normally in contact with the first and second power terminals 40*a*, 50*a* to tuin on the indicator lamp 70.

Figure 10:
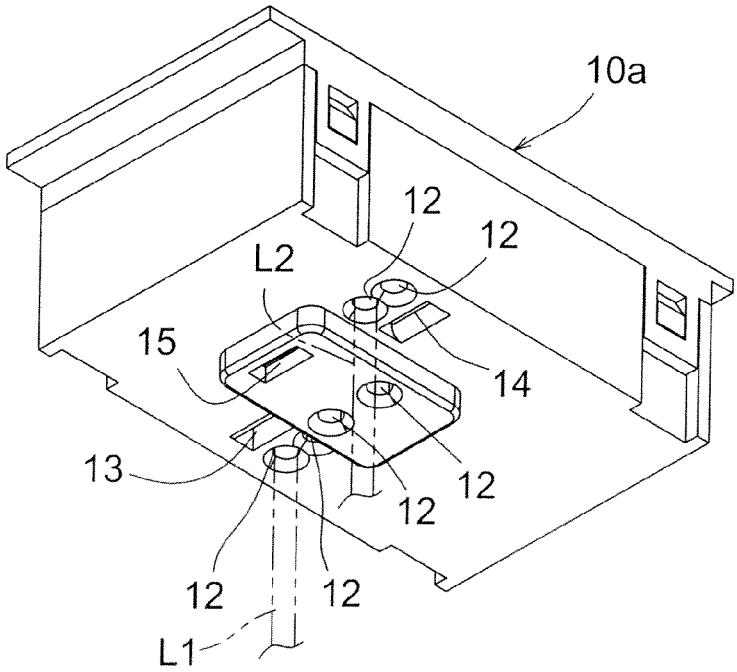
FIG. 10 is a perspective assembled view of the second embodiment of the present invention, seen in another direction.
Figure 11:
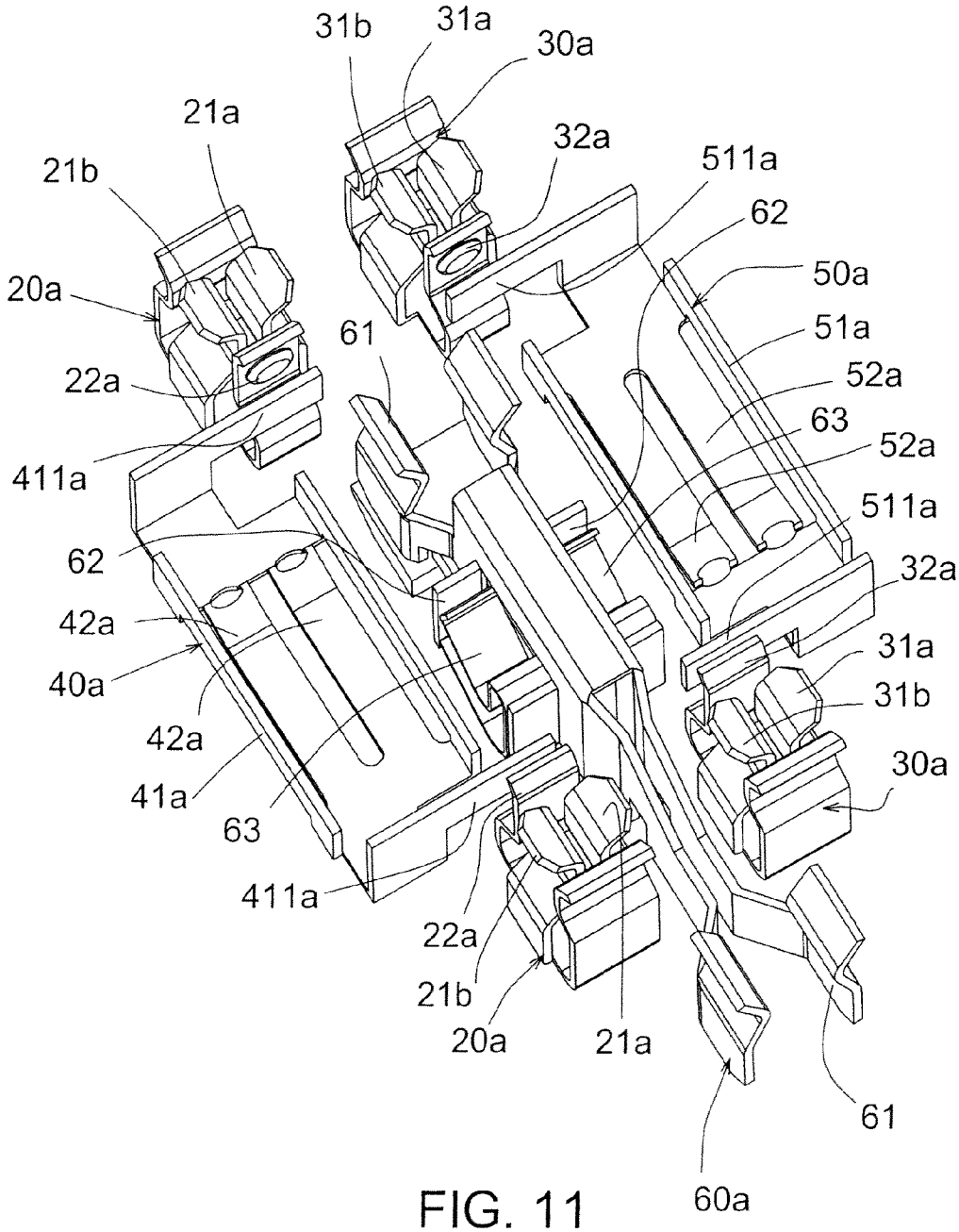
FIG. 11 is a perspective view of the second embodiment of the present invention, showing the internal structure thereof.

As shown in FIGS. 4 and 10, the perforations 13, 14, 15 of the main body 10 or 10*a* of the safety socket are in communication with the interior of the main body 10 or 10*a*. Accordingly, the water or water vapor entering the safety socket can leak or escape out of the safety socket to avoid the danger of leakage of electricity.

The safety socket of the present invention is characterized in that the first and second conductive clamp seats 20, 30 are projectively aligned with the first and second insertion holes 11*a*, 11*b* of the set 11 of insertion holes. In normal state, the first and second conductive clamp seats 20, 30 are spaced from the first and second power terminals 40, 50 to open the power circuit. Even if a child inserts a conductive article into the safety socket, no electrical shock will take place. Moreover, the safety socket of the present invention has a simple structure so that the manufacturing process of the safety socket is simplified to lower the manufacturing cost.

The above embodiments are only used to illustrate the present invention, not intended to limit the scope thereof. Many modifications of the above embodiments can be made without departing from the spirit of the present invention.

What is claimed is:

1. A safety socket comprising:

a main body formed with at least one set of insertion holes, each set of said insertion holes including a first insertion hole and a second insertion hole, the main body being further formed with a plurality of lead through holes;

a first power terminal mounted in the main body and connected to a first electrode power wire of a power supply;

a second power terminal mounted in the main body and connected to a second electrode power wire of the power supply;

an integrally formed first conductive clamp seat projectively aligned with the first insertion hole and mounted in the main body, a pair of clamp arms disposed on the integrally formed first conductive clamp seat for resiliently clamping opposing sides of a prong of a plug plugged in the socket, spring limbs extending from the integrally formed first conductive clamp seat, whereby the spring limbs can be outward biased by the prong of the plug plugged in the socket, the spring limbs extending from the integrally formed first conductive clamp seat toward the first power terminal in a first state; and an integrally formed second conductive clamp seat projectively aligned with the second insertion hole and mounted in the main body, a pair of clamp arms being disposed on the integrally formed second conductive clamp seat for resiliently clamping opposing sides of a prong of the plug plugged in the socket, spring limbs extending from the integrally formed second conductive clamp seat, the spring limbs extending from the integrally formed second conductive clamp seat toward the second power terminal in a first state, the first power terminal further comprising:

a frame section having a contact arm, the contact arm projecting from the frame section towards the spring limb of the integrally formed first conductive clamp seat in the first state;

a pair of power wire clamp arms disposed on opposing sides of the frame section and electrically connected to the frame section, each of said power wire clamp arms having an oblique arm section obliquely extending from the power wire clamp arm respectively corresponding to said pair of said plurality of lead through holes of the main body, the oblique arm section resiliently clamping the first electrode power wire inserted in one of the plurality of lead through holes and a lead for parallel connection;

an unlatching section positioned in the middle of the frame section and bridged between outer sides of the oblique arm sections of each of the power wire clamp arms, the unlatching section being aligned with a perforation of the main body for decoupling said unlatching section;

whereby inserting the prongs of the plug into the first and second insertion holes of the same set of insertion holes biases the spring limbs of the integrally formed first and second conductive clamp seats respectively into contacting the first and second power terminals in a second state to provide power for an electric appliance.

2. The safety socket as claimed in claim 1, wherein the second power terminal includes a frame body having a contact section, the contact section projecting from the frame body toward the spring limb of the integrally formed second conductive clamp seat in the first state, the second power terminal further including two power wire clamp arms positioned between two sides of the frame body and electrically connected with the frame body, each power wire clamp arm having an oblique arm section obliquely extending from the power wire clamp arm corresponding to two other lead through holes of the main body, the oblique arm sections serving to elastically clamp the second electrode power wire inserted in the lead through holes and a lead for parallel connection, the second power terminal further including an unlatching section positioned in the middle of the frame body and bridged between outer sides of the oblique arm sections of the power wire clamp arms, the unlatching section being aligned with another perforation of the main body.

3. The safety socket as claimed in claim 1, further comprising a grounding terminal, each set of insertion holes further including a grounding insertion hole, the grounding terminal being mounted in the main body in alignment with the grounding insertion hole, the grounding terminal being connected with a grounding lead.

* * * * *